US007028876B2

(12) United States Patent
Hirtl et al.

(10) Patent No.: US 7,028,876 B2
(45) Date of Patent: Apr. 18, 2006

(54) SETTING TOOL

(75) Inventors: Anton Hirtl, Gams (CH); Kai-Uwe Keller, Feldkirch-Tisis (AT); Mario Scalet, Schaan (LI); Michael Melocco, Mettlach (DE); Sybille Renner, Grabs (CH)

(73) Assignee: Hilti Aktiengesellschaft, Schaan (LI)

( * ) Notice: Subject to any disclaimer, the term of this patent is extended or adjusted under 35 U.S.C. 154(b) by 55 days.

(21) Appl. No.: 10/715,761

(22) Filed: Nov. 18, 2003

(65) Prior Publication Data

US 2004/0149801 A1 Aug. 5, 2004

(30) Foreign Application Priority Data

Nov. 19, 2002 (DE) ..... 102 53 668

(51) Int. Cl.
*B25C 1/14* (2006.01)

(52) U.S. Cl. ..... 227/8; 227/10

(58) Field of Classification Search ..... 227/8–11, 227/130, 156; 123/46 SC
See application file for complete search history.

(56) References Cited

U.S. PATENT DOCUMENTS

| | | | | |
|---|---|---|---|---|
| 3,863,824 | A * | 2/1975 | Bakoledis | 227/10 |
| 4,493,376 | A * | 1/1985 | Kopf | 227/10 |
| 4,598,851 | A * | 7/1986 | Kopf | 227/9 |
| 4,804,127 | A * | 2/1989 | Kirkman | 227/10 |
| 6,286,743 | B1 * | 9/2001 | Ehmig | 227/10 |

* cited by examiner

*Primary Examiner*—Scott A. Smith
(74) *Attorney, Agent, or Firm*—Abelman ,Frayne & Schwab

(57) ABSTRACT

A setting tool includes a sleeve-shaped housing (11), a piston guide (13) and an ignition unit (12) located in the housing (11), with the ignition unit (12) having a cartridge chamber bottom (19) for enclosing a propellant (25) in cartridge chamber (18), which is located between the piston guide (13) and the ignition unit (12) and a locking device (30) having a locking position (38) in which the ignition unit (12) is held in a pre-loaded position (28) against an energy accumulator (23) and in which the cartridge chamber (18) remains open, and having a release position (39) in which the ignition unit (12) is displaced to its ignition position (29) by the energy accumulator in which the cartridge chamber bottom (19) closes the cartridge chamber (18).

25 Claims, 10 Drawing Sheets

SETTING TOOL

BACKGROUND OF THE INVENTION

1. Field of the Invention

The present invention relates to a setting tool having a sleeve-shaped housing, a piston guide, a piston displaceable in the piston guide, an ignition unit located in the housing and axially displaceable therein, a cartridge chamber arranged between the piston guide and the ignition unit, with the ignition unit having a cartridge chamber bottom for enclosing a propellant in the cartridge chamber and an ignition element for igniting the propellant.

2. Description of the Prior Art

Setting tools of the type described above can be driven by solid fuels in powder form or pellet form. In this setting tool, the setting or drive piston is driven by combustion gases. With the setting piston, fastening elements are driven into constructional components. German Publication DE-19544105A1 discloses an explosive powder charge-operated setting tool in which a piston guide and an ignition unit with a displaceable ignition pin are arranged in the tool housing, with the piston guide and the ignition unit axially movable relative to the housing against a biasing force of damping means supported in the housing. Before start of a setting process, first, a propellant should be enclosed in the cartridge chamber of the setting tool. To this end, upon the setting tool being pressed against a constructional component, the piston guide that carries the cartridge chamber, in which at that point in time an unused cartridge is located, is pressed against the ignition unit. The ignition unit carries the cartridge chamber bottom that closes the cartridge chamber, enclosing the propellant (cartridge) in the cartridge chamber. The ignition of the propellant is effected upon actuation of the ignition pin that projects forward from the ignition unit. The drawback of the known setting tool consists in that because of a comparatively long time the propellant is enclosed in the cartridge chamber, after a prolong operation of the setting tool, the propellant can self-ignite because of heating of the cartridge chamber.

Accordingly, an object of the present invention is to provide a setting tool of the type described above in which the above-discussed drawback is eliminated.

SUMMARY OF THE INVENTION

This and other objects of the present invention, which will become apparent hereinafter, are achieved by providing in a setting tool, a locking device having a locking position in which the ignition unit is held in a pre-loaded position against an energy accumulator and in which the cartridge chamber remains open, and having a release position in which the ignition unit is displaced to its ignition position by the energy accumulator and in which the cartridge chamber bottom closes the cartridge chamber.

A setting tool according to the present invention is characterized by a locking device or mechanism with which the ignition unit is held in a pre-loaded position against an energy accumulator in which the cartridge chamber remains open. Upon actuation of appropriate actuation means, the locking device releases the ignition unit which is displaced in its ignition position by the energy accumulator. The cartridge chamber bottom, which is carried by the ignition unit, closes the cartridge chamber, and the ignition element, which is also carried by the ignition unit, ignites the propellant enclosed in the cartridge chamber. The elements according to the present invention insure that the propellant remains in the cartridge chamber for a very short time and that the cartridge chamber, which becomes heated after a prolong use of the setting tool is held at a distance from the cartridge strip. The ignition unit is displaced into its ignition position after actuation of the ignition process very rapidly, so that the thermal conditions, which lead to an undesirable ignition of the propellant, are prevented.

In an ideal case, the ignition element, e.g., an ignition peg or pin is fixedly secured on the ignition unit and is displaceable therewith. This permits to initiate ignition of the propellant simultaneously with the closing of the cartridge chamber with the cartridge chamber bottom that is carried by the ignition unit. The present invention permits to eliminate a number of components and manufacturing processes during manufacturing of the setting tool, as there is no need in a separate, displaceable ignition pin.

The locking device according to the present invention can include at least one locking element, which can be formed, e.g., as a pivotally supported locking pawl. In the locking position of the locking device or the locking element, the pawl section of the locking pawl extends into the displacement path of the ignition unit, holding the ignition unit against a biasing force of the energy accumulator acting on the ignition unit. The locking pawl can be pivoted out of the displacement path of the ignition unit with a very simple mechanism, e.g., upon actuation of the actuation switch. Preferably, in an advantageous embodiment of the present invention, the locking element or the locking pawl is supported on a bearing axle supported on the housing, which permits to obtain a very robust constructions.

When the locking element is supported on a bearing axle that is carried by a servo component displaceably arranged on the setting tool, the locking element can function as entrain member for the ignition unit. With such an entrain member, the ignition unit can be displaced, after the setting process has been initiated and completed, again to its intermediate position, i.e., in its ignition-ready, pre-loaded position. The servo component can be fixedly connected with the piston guide and/or the bolt guide or even formed with the piston or bolt guide as a one-piece part. Thus, during a press-on process, the servo-component, together with the locking element, entrain member, can be displaced together with the displacement of the piston guide and/or bolt guide, displacing the ignition unit into its ignition-ready position.

In order to be able to use the complete press-on path of the setting tool, the servo-component has a length corresponding to a maximal press-on path of the setting tool.

In an advantageous embodiment of the present invention, the setting tool is provided with a safety element, e.g., a catch pawl. The safety element extends, in its safety or locking position, into the displacement path of the ignition unit. With the safety element, the catch pawl, the ignition unit can be held back, upon opening of the cartridge chamber as a result of spring-back or recoil of the ignition unit, from impacting the cartridge chamber again. This advantageously prevents multi-ignition of the propellants located in the cartridge chamber during a setting process.

Advantageously, the locking element and/or the safety element are spring-biased toward their respective locking positions. As a result, means needs to be provided for pivoting the locking element and/or the safety element out of the displacement path of the ignition unit. However, both elements are automatically displaced by spring means into their respective locking positions.

As the locking element, the safety element, the catch pawl, can also be formed as an entrain member with which the ignition unit can be displaced to its ignition-ready, pre-loaded position.

An entrain member can be displaced out of the displacement path of the ignition unit to its release position in a simple way by crank means such as, e.g., sliding block, crank guide, or the like.

When the locking pawl is so arranged in the rear region of the setting tool so that the pawl section, which extends into the interior of the housing, is spaced from a stop provided at the rear end of the housing by a distance corresponding substantially to the length of the ignition unit and the length of a damping element, in case the damping element is arranged in the housing against the stop, the ignition unit can be held in its pre-loaded position against the biasing force of an energy accumulator or a spring when the ignition unit is displaced to its pre-loaded position as a result of recoil or spring back.

According to a further advantageous embodiment of the present invention, the guide for a cartridge strip is so secured that in the inoperative position of the setting tool, when the setting tool is not pressed against a constructional component, the cartridge strip is spaced from both the cartridge chamber and the ignition unit.

According to another advantageous embodiment of the present invention, the guide for the cartridge strip is secured at the front end of the ignition unit on its side facing the cartridge chamber and is displaceable with the ignition unit. With this arrangement of the cartridge strip guide, heat transmission from a heated cartridge chamber to the cartridge strip, in the inoperative position of the setting tool, is also prevented.

The novel features of the present invention, which are considered as characteristic for the invention, are set forth in the appended claims. The invention itself, however both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
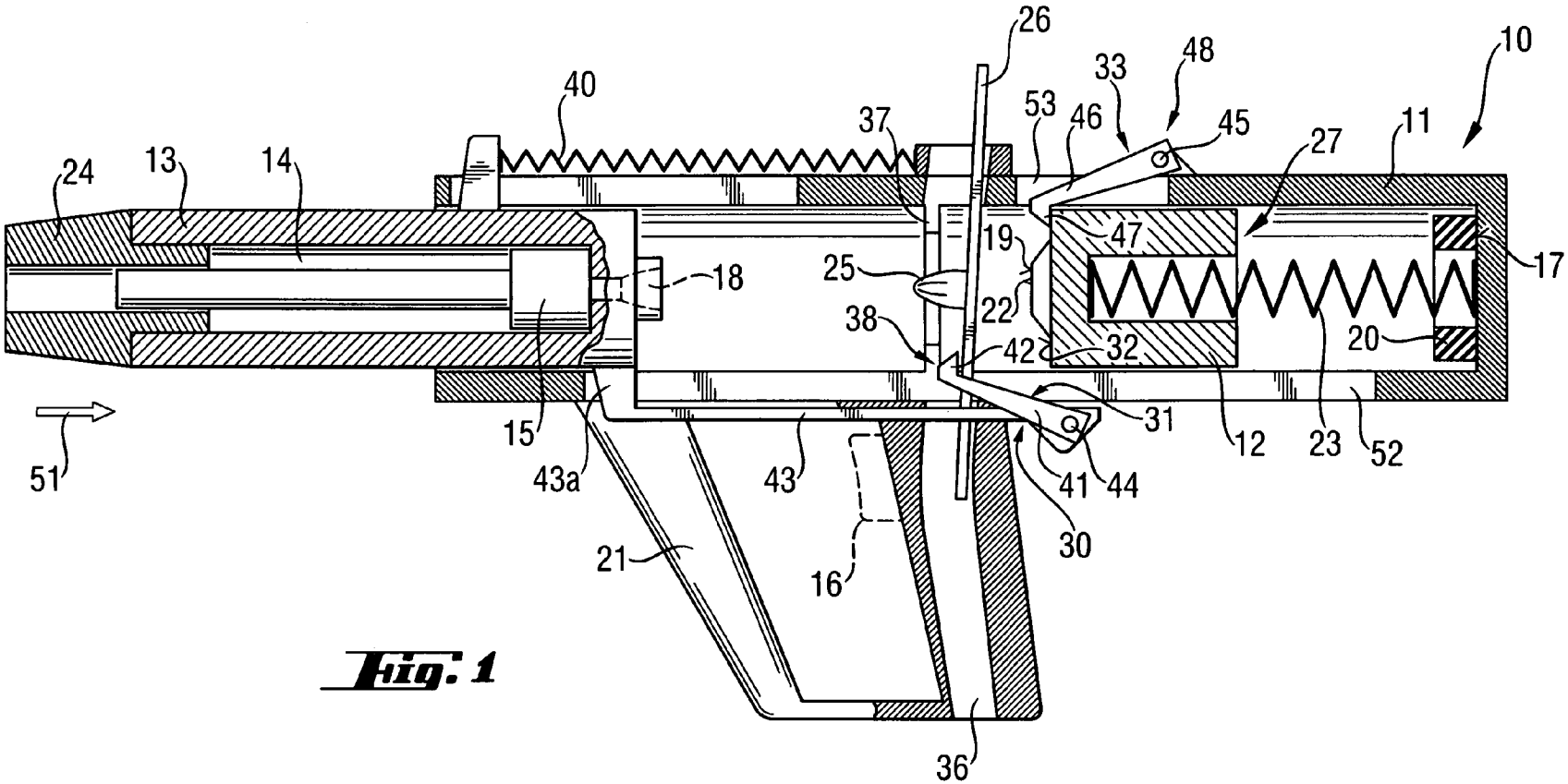
FIG. 1 a longitudinal cross-sectional view of a first embodiment of a setting tool according to the present invention in an inoperative position thereof.

A setting tool 10 according to a first embodiment of the invention and which is shown in its inoperative position in FIG. 1, includes a one- or multi-part housing 11 and a piston guide 13 supported in the housing 11. A piston 15 is displaceably supported in a hollow chamber 14 of the piston guide 13. The piston 15 is driven by propellant 25 or its expending combustion gases. In the embodiment shown in FIGS. 1–5, a handle 21 is secured on the housing 11. The handle 21 carries an actuation switch 16 for initiating a setting process by a user of the setting tool 10. The handle 21, which is shown in FIGS. 1–5, is not shown in FIGS. 6–10, though the setting tool shown in FIGS. 6–10 can also be provided with a similar handle. It should be understood that the setting tool 10, in addition to the housing 11, can have further housing components or an outer protection housing formed, e.g, of a plastic material.

The piston guide 13 is displaceable arranged in a sleeve-shaped housing 11 and is supported against the housing 11 by a spring 40. In a portion of the housing 11 remote from the piston guide 13, there is arranged an ignition unit 12 which is supported against a rear stop 17 provided in the housing 11 by an energy accumulator 23, e.g., a spring. At the front of the ignition device 12, i.e., on its side adjacent to the piston guide 13, there is provided a bottom 19 of a cartridge chamber and from which an ignition element 22 projects. The ignition element 22 is formed as an ignition peg.

In the housing 11, there is also provided a damping element 20 likewise supported against the stop 17. The damping element 20 is designed for absorbing the recoil of the ignition unit 12 after the ignition. In the embodiments shown in the drawings, the damping element 20 is formed as an elastic ring member. However, other embodiments of the damping element 20 can be used such as, e.g., a hydraulic shock absorber that can be combined with a spring element.

The spring 40 can be formed, e.g., as a compression spring, so that the piston guide 13 at least partially extends from the housing 11, when the setting tool is not pressed against a constructional component, as shown in FIG. 1. A setting process with the setting tool 10 can only be initiated when the setting tool 10 is pressed against a constructional component with its bolt guide 24 which is located in front of the piston guide 13. It should be pointed out that the bolt guide 24 can also be displaceable arranged relative to the piston guide 13.

In the housing 11, there is further arranged a stop 37 against which the piston guide 13 is displaced when, upon the setting tool being pressed against a constructional component, it moves inward into the housing 11, and against which the ignition unit 12 moves in opposite direction when being displaced to its ignition position.

Figure 2:
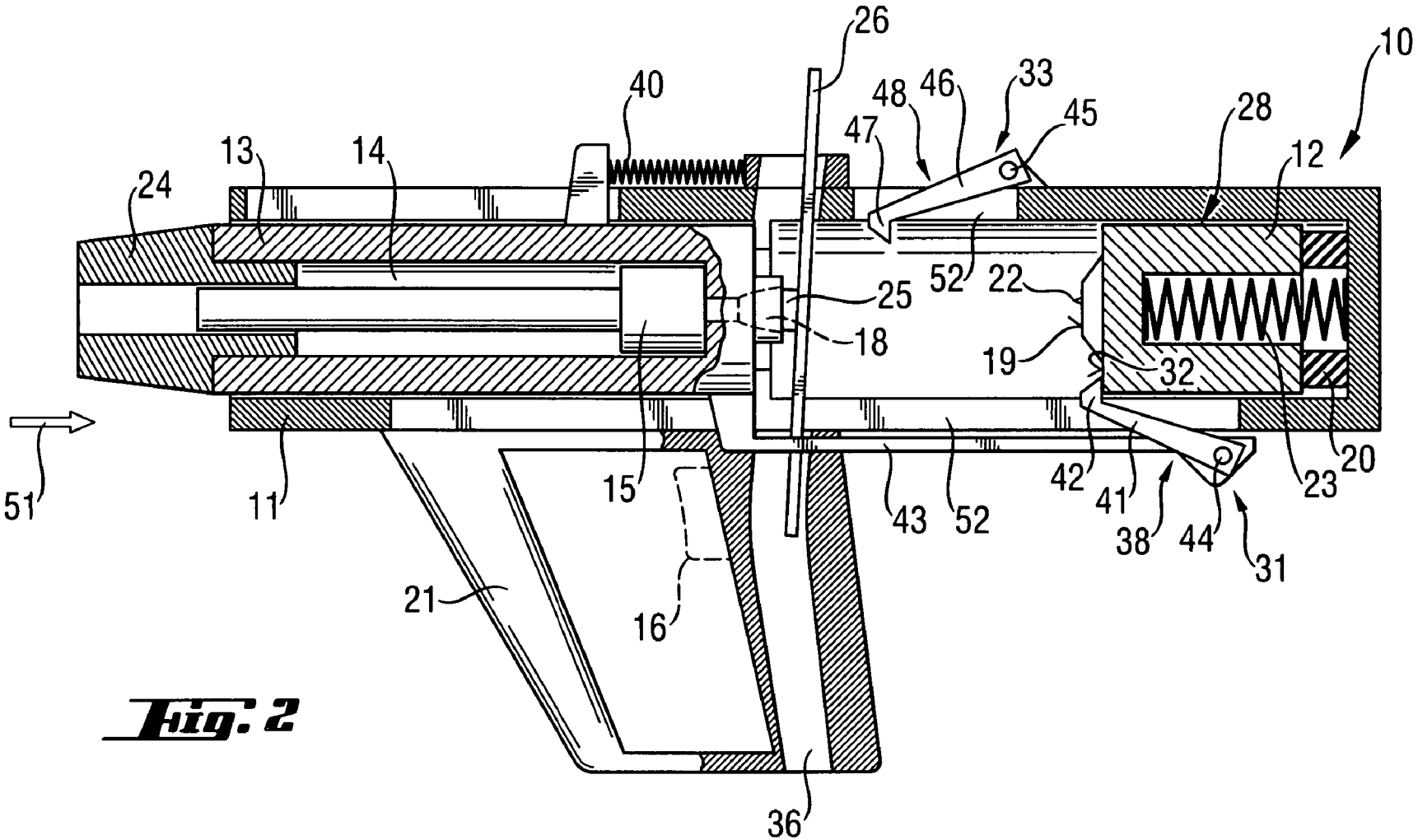
FIG. 2 a longitudinal cross-sectional view of the setting tool shown in FIG. 1 in a press-on condition of the tool.

On the piston guide 13, there is further provided a cartridge chamber 18 in which the propellant 25 is received, as shown in FIG. 2. The propellant 25 in the embodiment shown in the drawings is in form of a cartridge retainable in a cartridge strip 26. In the drawings, the cartridge strip 26 is shown, for the sake of clarity, with a single cartridge, with other cartridges not being shown. The cartridge strip 26 is displaced in a guide 36 by a transporting mechanism (not shown) that advances a single cartridge after completion of a setting process.

The setting tool 10 further includes a locking device 30 that can temporary retain the ignition unit 12 in a pre-loaded condition which is shown in FIG. 2. The locking device 30 essentially includes a pivotal locking element 31 that is supported on a bearing axle 44 that forms part of a servo-component 43. In the embodiment shown in the drawings, the locking element 31 is formed as a detent pawl 41. The servo-component 43 is formed as a rod-shaped member and is fixedly connected with the piston guide 13. The servo-component 43 forks off at its front end 43*a*, forming an extension extending through a recess 52 in the housing 11.

A safety element 33, which is formed as an entrain member, is pivotally supported on an axle 45 located outside of the housing 11. The safety element 33 is designed for catching the bouncing ignition unit 12 after completion of the ignition process. In the embodiments shown in the drawings, the safety element 33 is formed as a catch pawl 46. In FIG. 1, the catch pawl 46 is shown in its locking position 48 in which the catch pawl 46 retains the ignition unit 12 in an intermediate position 27, preventing the ignition unit 12 from being driven by the energy accumulator 23 toward the propellant 25. The catch pawl 46 extends through a recess 53 or slot in the housing 11.

FIG. 2 shows a position of the setting tool 10 when the tool is pressed against a constructional component. The piston guide 13 is displaced into the housing 11 against the biasing force of the spring 40, whereby the propellant 25 is received in the cartridge chamber 18. However, practically, the propellant 25 has no contact with the walls of the cartridge chamber 18. The locking pawl 41 extends through the recess 52 in the housing 11, engaging with its pawl section 42 an engagement part 32 of the ignition unit 12. Upon displacement of the piston guide in a direction 51, which is opposite the setting direction, the locking pawl 41, which extends through the recess 52 into the interior of the housing 11, engages with its pawl section 42, which acts as entrain member, the ignition unit 12, displacing it into the pre-loaded position 28, as shown in FIG. 2. The energy accumulator 23, which is formed as a spring, is completely stressed, and the ignition unit 12 abuts the damping element 20. The catch pawl 46 extends through the slot or recess 53, with the catch section 47 of the catch pawl 46 projecting into the interior of the housing 11.

Figure 3:
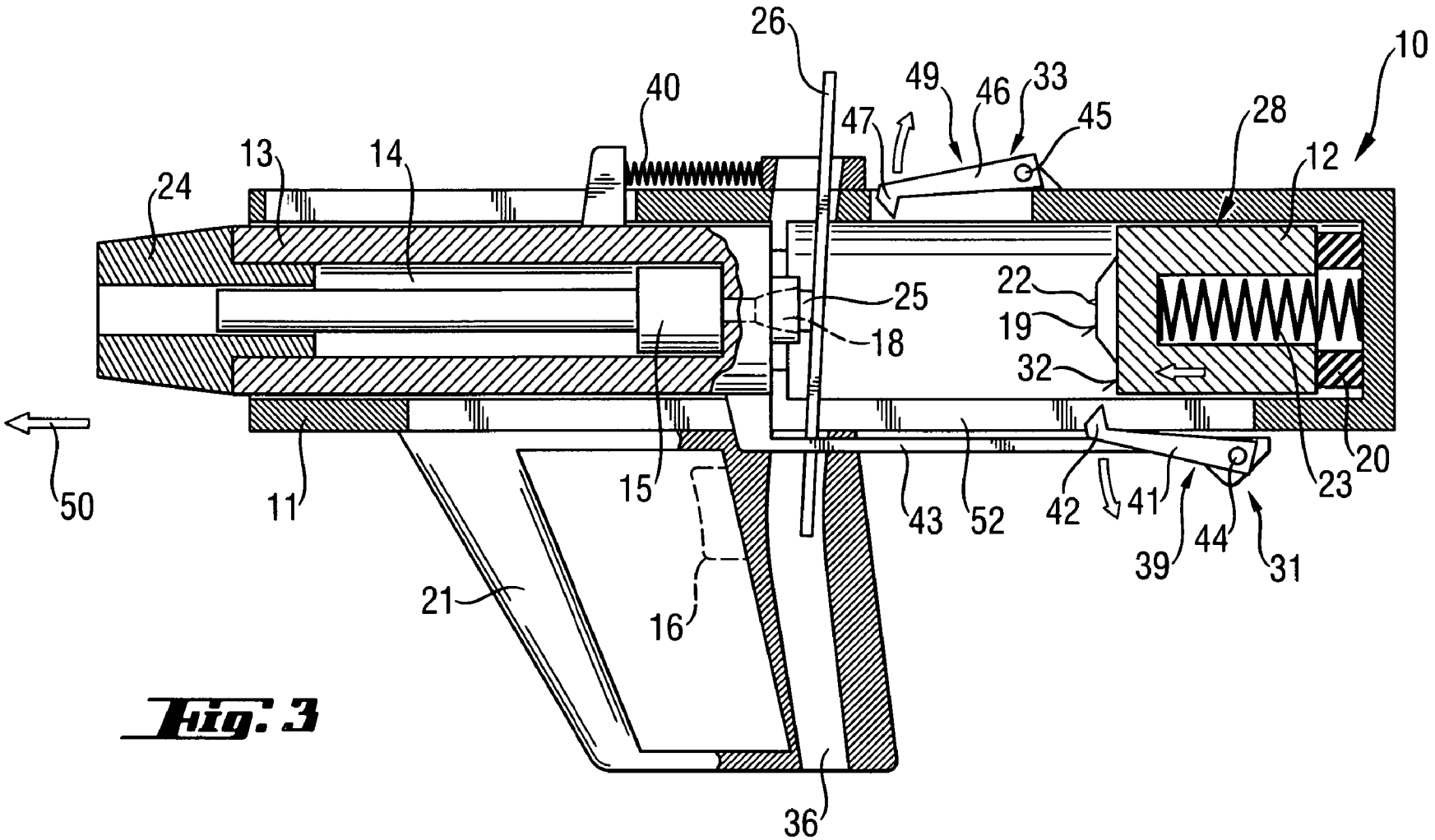
FIG. 3 a longitudinal cross-sectional view of the setting tool shown in FIG. 1 in a press-on condition of the tool with an actuated ignition unit.

In the position shown in FIG. 3, with the setting tool 10 being pressed against a constructional component, the actuation switch 16 on the handle 21 is actuated, pivoting, with appropriate means (not shown), the locking pawl 41 and the catch pawl 46 from their locking positions 38, 48, respectively, to their release positions 39, 49, respectively. The catch section 47 of the catch pawl 46 and the pawl section 42 of the locking pawl 41 are pivoted out of the interior of the housing 11, freeing the displacement path of the ignition unit 12 in the setting direction 50 toward the piston guide 13.

Figure 4:
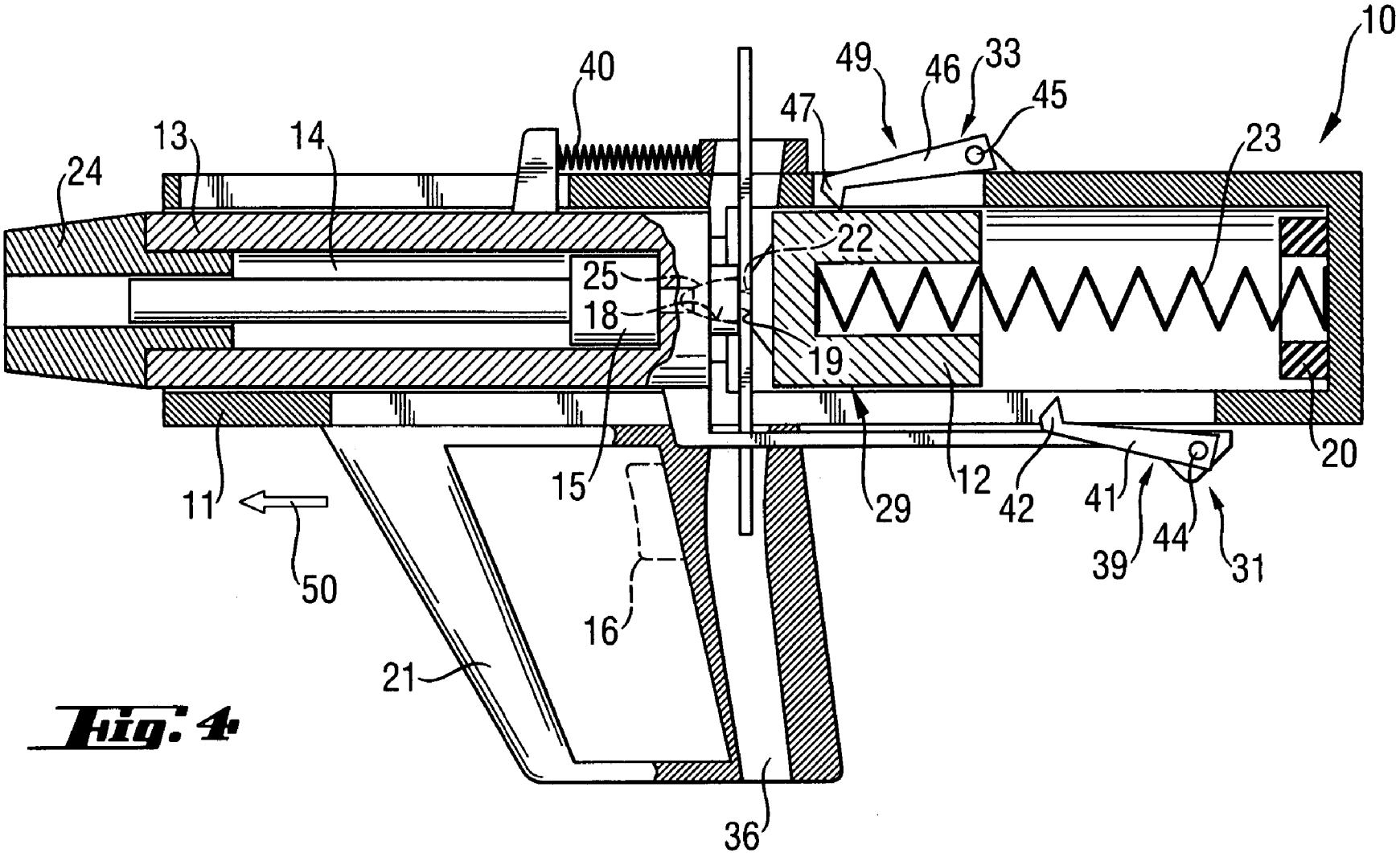
FIG. 4 a longitudinal cross-sectional view of the setting tool shown in FIG. 1 in a press-on condition of the tool with an actuated ignition unit, and with the propellant in the cartridge chamber.

FIG. 4 shows a position in which the ignition unit 12 is already displaced by the energy accumulator 23 in the setting direction 50 to its ignition position 29 to the cartridge chamber 18 in which the propellant 25 is located. When the ignition unit 12 impacts the cartridge chamber (18), a switch mechanism (not shown) is actuated, again actuating the catch pawl 46, pivoting it again into the interior of the housing 11. The pivoting of the catch pawl 46 into the interior of the housing 11 can be effected, e.g., by a spring element provided between the axle or bearing point 45 and the catch pawl 46. The locking pawl 41 remains in its release position 39.

Figure 5:
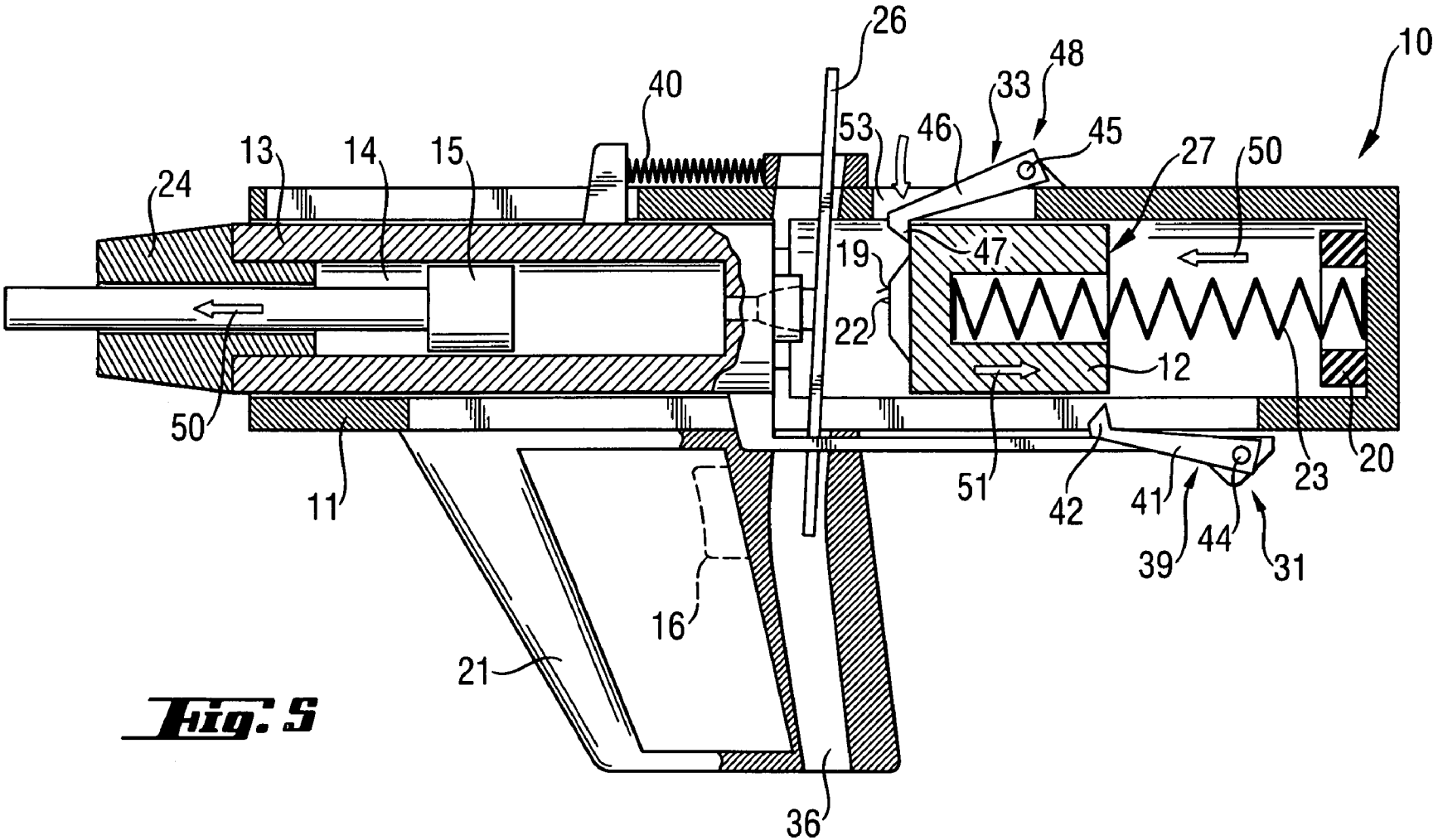
FIG. 5 a cross-sectional longitudinal view of the setting tool shown in FIG. 1 in the press-on condition of the tool after completion of a setting process.

FIG. 5 shows a position in which the drive piston 15, which is located in the hollow chamber 14 of the piston guide 13, has already been displaced forward in the setting direction 50 under the action of a drive force generated by ignition of the propellant 25. In this position, the drive piston 15 can drive a fastening element (not shown) in a constructional component. The ignition unit 12 has been displaced by a return kick in the direction 51 opposite the setting direction 50 against the damping element 20 and has bounced back in the setting direction 50 against the catch section 47 of the catch pawl 46 that had been displaced, as discussed above, into its locking position 48.

Upon release of the actuation switch 16 by the tool user, the locking pawl 41 is again pivoted into the interior of the housing 11. Upon the setting tool 10 being lifted off the constructional component, the piston guide 13 is displaced out of the housing 11, with the setting tool 10 again occupying its inoperative position shown in FIG. 1. The advantage of the shown embodiment of the invention consists in spacing of the guide for the cartridge stip 26 from the ignition unit 12 and the piston guide 13 and the cartridge chamber 18 formed therein, which reduces the heat action on propellants, in particular, after several settings when both the ignition unit 12 and the piston guide 13 become relatively hot. The time the propellant remains in the cartridge chamber amounts only to several milliseconds, so that no noticeable thermal action on the cartridge strip takes place.

Figure 6:
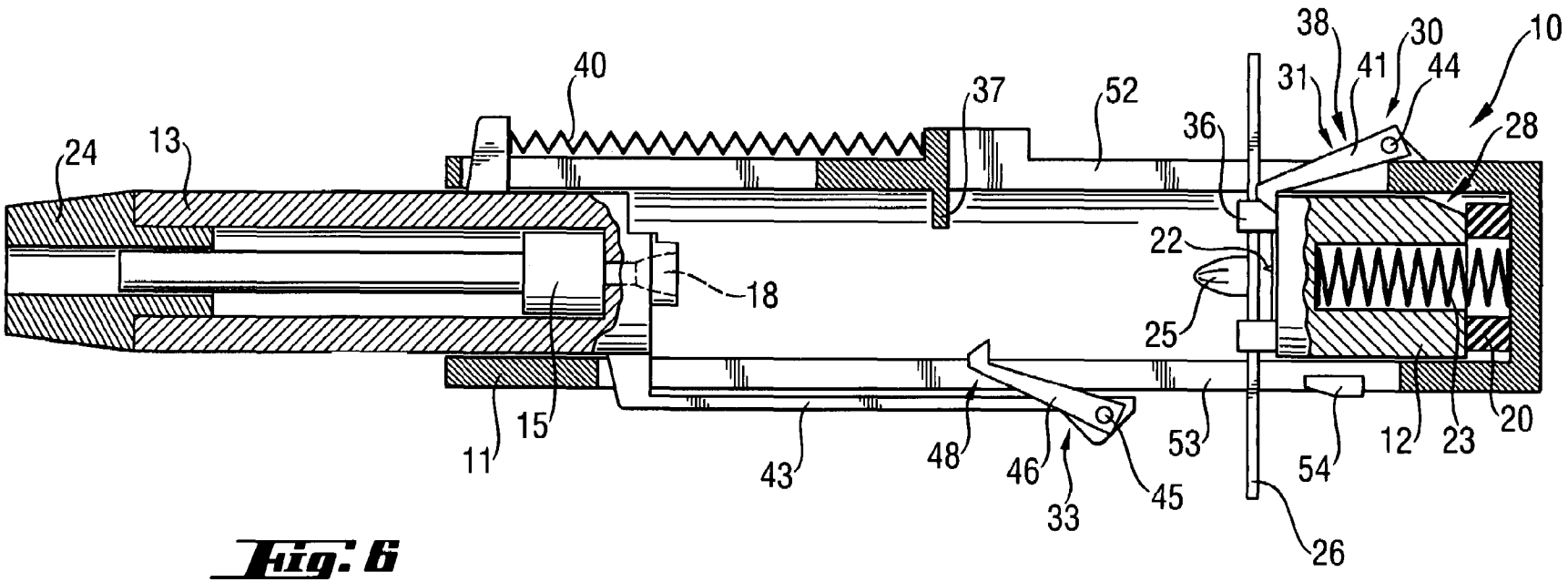
FIG. 6 a longitudinal cross-sectional view of a second embodiment of a setting tool according to the present invention in an inoperative position thereof.
Figure 7:
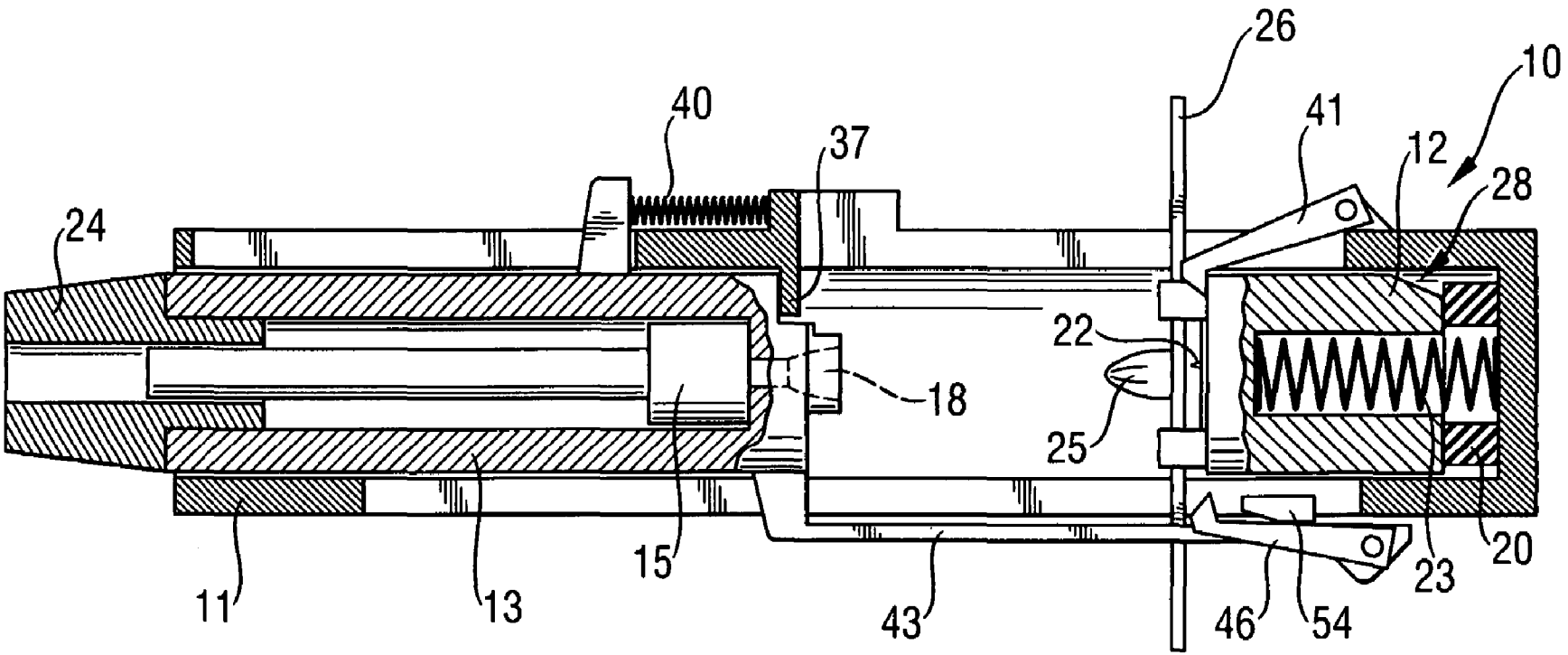
FIG. 7 a longitudinal cross-sectional view of the setting tool shown in FIG. 6 in a press-on condition of the tool.
Figure 8:
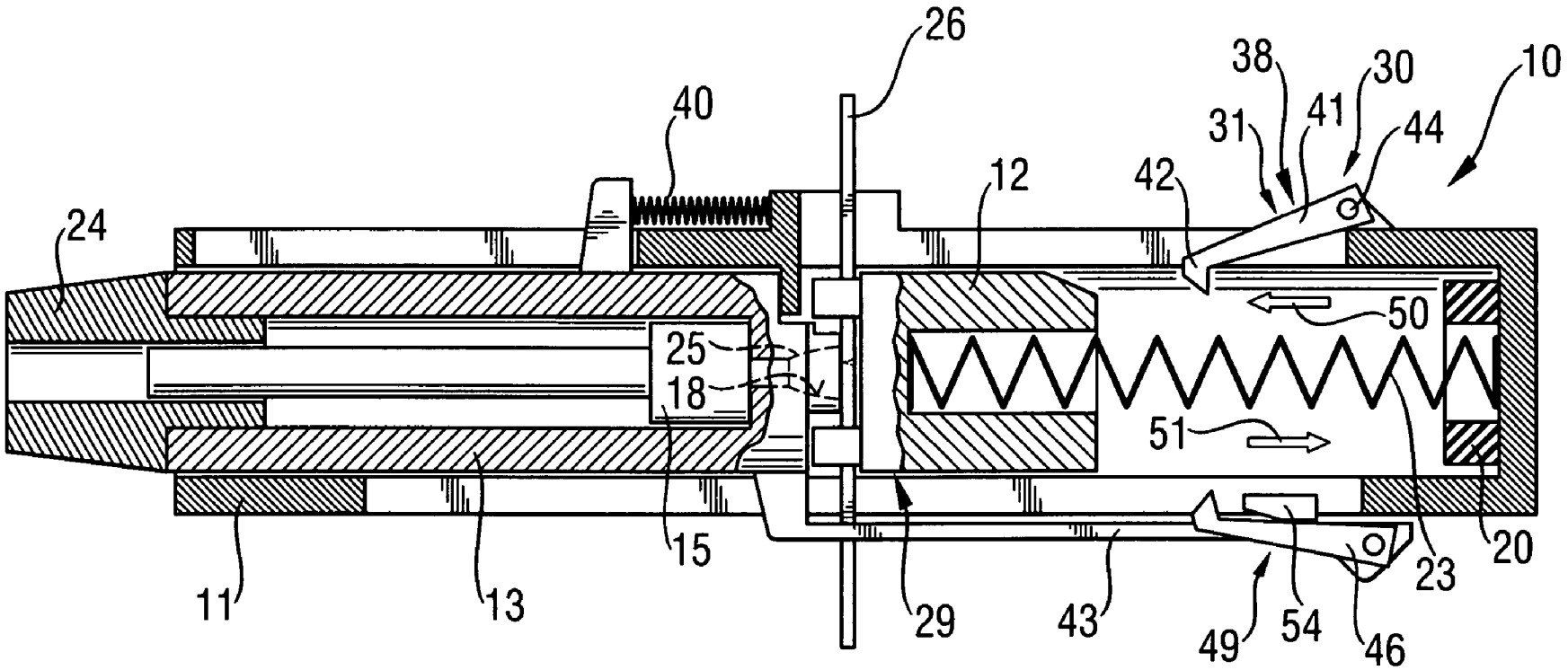
FIG. 8 a longitudinal cross-sectional view of the setting tool shown in FIG. 6 in a press-on condition of the tool with an actuated ignition unit, and with the propellant in the cartridge chamber.

The embodiment of the setting tool according to the present. invention, which is shown in FIGS. 6–8, differs from that shown in FIGS. 1–5, in that the guide 36 for the cartridge strip 26 is not arranged on the housing 11 but rather is arrange at a front section of the ignition unit 12 and is displaced therewith. Thus, the cartridge strip 26 is movable with the ignition unit 12 that is displaced from its pre-loaded position 29 (shown in FIG. 8) and in the opposite direction. As it has been mentioned above, for clarity sake, the handle 21 and the actuation switch 16 are now shown in this embodiment.

The embodiment shown in FIGS. 6–8 further differs from that shown in FIGS. 1–5 in that the locking element 31, which is formed as a locking pawl 41 is supported on the axle 44 which is supported in the housing 11 and not on the piston guide 13. Further, the locking pawl 41 does not function any more as an entrain member for the ignition unit 12. As an entrain member, the catch pawl 46 or the safety element 33, which is supported on the axle 45 forming part of the servo-component 43 fixedly connected with the piston guide 13, is used. For displacing the catch pawl 46 in the recess 53 in the housing 11, there is provided a crank means 54 that pivots the catch pawl 46 out of the interior of the housing 11 when the setting tool 10 is completely pressed against a constructional component.

FIG. 6 shows the setting tool 10 according to the second embodiment in its inoperative position in which the setting tool 10 is ready to be ignited, with the ignition unit 12 located in its pre-loaded position 28 against the energy accumulator 23. The ignition unit 12 is held in this position by the locking pawl 41. The piston guide 13 projects out of the housing 11, and the catch pawl 46 projects into the interior of the housing 11 for catching the ignition unit 12 in case it is displaced, for some reason, forward, without the actuation of the setting tool 10.

FIG. 7 shows a position in which the setting tool 10 is pressed against a constructional component. The piston guide 13 is displaced into the housing 11. The catch pawl 46 is pivoted out of the interior of the housing 11 by the crank means 54. However, the locking pawl 41 still engages the ignition unit 12, retaining it in its pre-loaded position 28.

FIG. 8 shows a position in which the actuation switch (discussed with reference to FIG. 1) has been actuated, and the locking pawl 41 for a short time has been pivoted out of the interior of the housing 11 to its release position. In this position, the ignition unit 12, together with the propellant 25, can be displaced by the energy accumulator 23 in the setting direction 50 toward the cartridge chamber 18 in order to place the propellant. 25 into the cartridge chamber 18 and to ignite the propellant 25.

After the ignition, the ignition unit 12 is displaced, as a result of the return kick produced by the explosion of the propellant 25, in the opposite direction 51 against the damping element 20 and then bounces back against the pawl section 42 of the locking pawl 41 which has already been pivoted into its locking position 38. When the setting tool 10 is lifted of the constructional component, the catch pawl 46 is displaced forward by the crank means 54 forming part of the servo-component 43 that is displaced in the setting direction 50 together with the piston guide 13, and is pivoted by a return spring (not shown) into the interior of the housing 11 to its locking position 48, as shown in FIG. 6.

For discussion of elements shown in FIGS. 6–8 and not specifically discussed here, reference can be made to the discussion of these elements which was made with reference to FIGS. 1–5.

Figure 9:
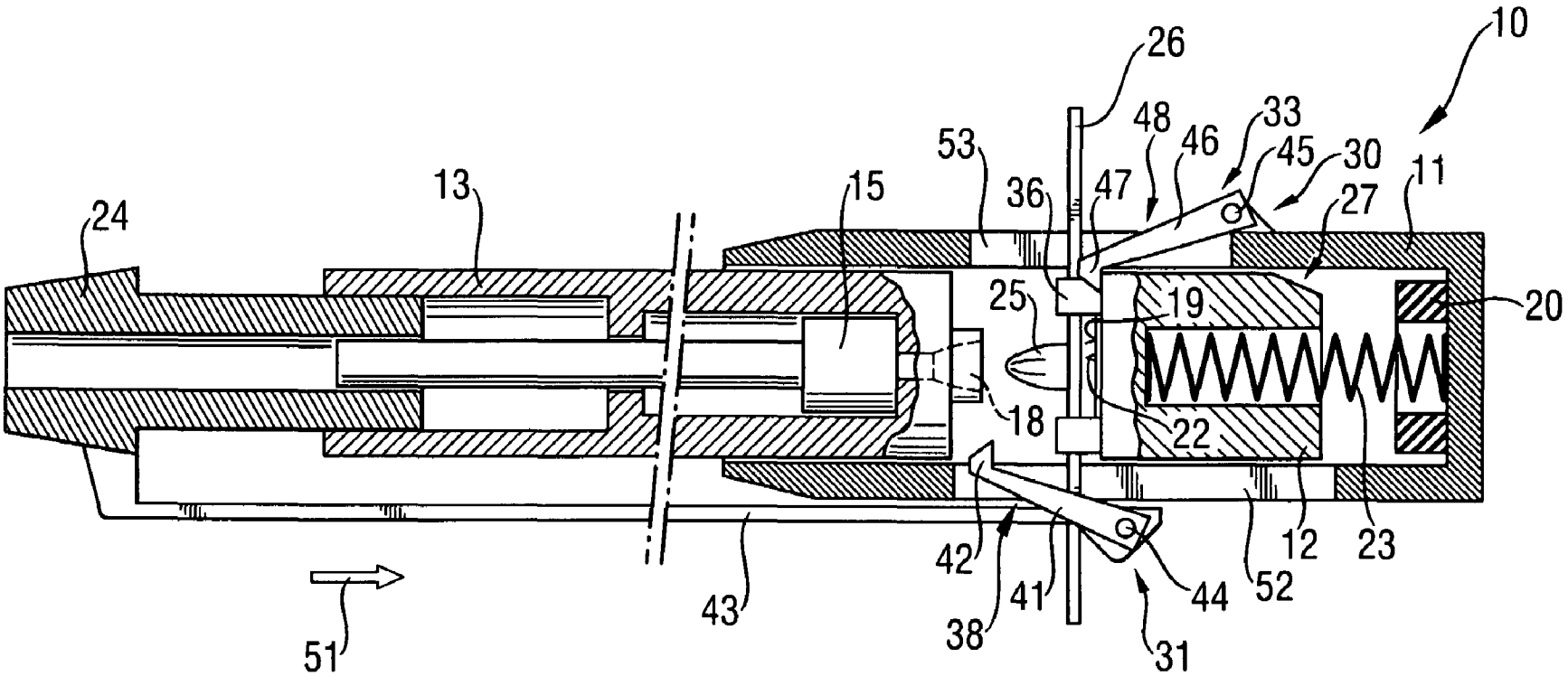
FIG. 9 a longitudinal cross-sectional view of a third embodiment of a setting tool according to the present invention in an inoperative position thereof.
Figure 10:
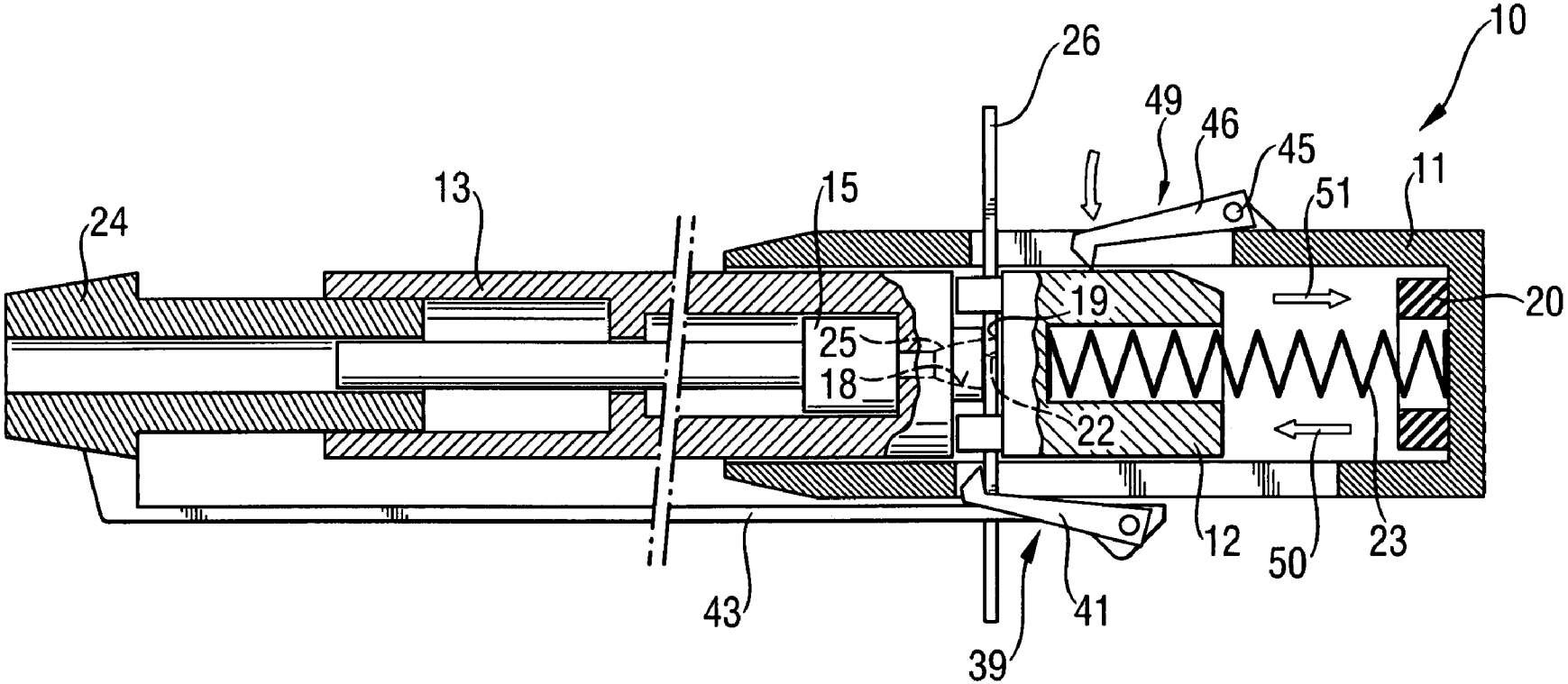
FIG. 10 a longitudinal cross-sectional view of the setting tool shown in FIG. 9 in a press-on condition of the tool with an actuated ignition unit, and with the propellant in the cartridge chamber.

A setting tool according to the third embodiment, which is shown in FIGS. 9–10, differs from those described above in that the piston guide 13 is fixedly secured in the sleeve-shaped housing 11. When the setting tool 10 is pressed against a constructional component, the bolt guide 24 is displaced relative to the piston guide 13 (this is not shown here) as the bolt guide 24 in this embodiment is displaceably arranged in the setting tool 10 (the bolt guide can also be displaceably arranged in the setting tool in the embodiments discussed above). As in the first embodiment shown in FIGS. 1–5, the locking element 31 of the locking device 30 is supported on the axle 44 forming part of the servo-component 43 formed as a rod-shaped member. The locking element 31 is formed, as in the embodiment shown in FIGS. 1–5, as a locking pawl 41 having a pawl section 42 that projects, in the locking position 38 of the locking pawl 41 (FIG. 9) through the recess 52 into the interior of the housing 11. However, in the embodiment shown in FIGS. 9–10, the servo-component 41 is connected with the bolt guide, being displaceable therewith against the housing 11 and the piston guide 13. The safety element 33 or the catch pawl 46 is pivotally supported on the axle 45 secured, as in the embodiment shown in FIGS. 1–5, on the housing 11. In the locking position 48, the pawl section 47 of the catch pawl 46 projects through the recess 53 in the interior of the housing 11.

In the embodiment of the setting tool shown in FIGS. 9–10, as in the second embodiment shown in FIGS. 6–8, the guide 36 for the cartridge strip 26 is arranged at the front section of the ignition unit 12 and is displaced therewith.

FIG. 9 shows the setting tool 10 according to a third embodiment of the present invention in its inoperative position. The ignition unit 12 is held by the catch pawl 46, which is located in its locking position 48, in its intermediate position 27. When the setting tool 10 is pressed against a constructional component, the servo-component 43 and the locking pawl 41, which is carried thereby, are displaced together with the bolt guide in the direction 51. The guide unit 12 is catched by the locking pawl 41 and is displaced thereby rearwardly until it impacts the damping element 20. The ignition unit 12 is in its pre-loaded position (not shown). As in the embodiment shown in FIGS. 1–5, upon actuation of the actuation switch (such as the switch 16 carried by the handle 21 in FIG. 1), both pawls 41, 46 pivot to their respective release positions (not shown).

FIG. 10 shows a position in which the setting tool 10 is actuated, and the ignition unit 12, together with the ignition peg 22 and the cartridge chamber bottom 19, is displaced by the energy accumulator 23 in the setting direction 50 toward the cartridge chamber 18. The propellant 25 is clamped in the cartridge chamber 18 by the ignition peg 22 and is ignited thereby. When the ignition unit 12 impacts the cartridge chamber 18, a switching mechanism (not shown) is actuated and displaces the catch pawl 46 again into the interior of the housing 11. This displacement can be effected with a spring element operable between the axle 45 and the catch pawl 46. The locking pawl 41 remains in its release position 39.

As a result of an explosion, the ignition unit 12 is kicked back in the direction 51 against the damping element 20, bouncing therefrom in the setting direction 50 against the pawl section 47 of the catch pawl 46 which is in its locking position 48 (not shown, see FIG. 5). When the setting tool 10 is lifted off the constructional component, the bolt guide is displaced in the setting direction 50 away from the piston guide 13, and the locking pawl 41 again pivots in the interior of the housing 11, with the setting tool 10 now occupying its inoperative position shown in FIG. 9.

It should be pointed out that the energy accumulator 23 can be so arranged that it is practically not stressed when the setting tool is in its inoperative position. As it was discussed with reference to the embodiments shown in FIGS. 1–8, the setting tool 10 shown in FIGS. 9–10 also can have the handle 21 with an actuation switch 16, which are not shown for clarity sake.

It should be further pointed out that the setting tool of all of the embodiments can be provided with a piston return mechanism and a mechanism for displacing cartridges and the cartridge strip. Further, there can be provided means for displacing, upon actuation of the actuation switch, the locking and safety elements and, if necessary, other elements and/or devices, e.g., a cartridge transporting mechanism. Further, different elements of the different embodiments can be combined with each other. E.g., it is possible to combine elements of the embodiments shown in FIGS. 1–5 and FIGS. 6–8, with the cartridge strip guide being secured to the housing, as in the embodiment of FIGS. 1–5, but with the ignition unit being displaced to its pre-loaded position as a result of the recoil of the setting tool, as in the embodiment of FIGS. 6–8.

Though the present invention was shown and described with references to the preferred embodiments, such are merely illustrative of the present invention and are not to be construed as a limitation thereof and various modifications of the present invention will be apparent to those skilled in the art. It is therefor not intended that the present invention be limited to the disclosed embodiments or details thereof, and the present invention includes all variations and/or alternative embodiments within the spirit and scope of the present invention as defined by the appended claims.

What is claimed is:

1. A setting tool, comprising a sleeve-shaped housing (11); a piston guide (13); a piston (15) displaceable in the piston guide (13); an ignition unit (12) located in the housing (11) and axially displaceable therein; a cartridge chamber (18) arranged between the piston guide (13) and the ignition unit (12), the ignition unit (12) having a cartridge chamber bottom (19) for enclosing a propellant (25) in the cartridge chamber (18) and an ignition element (22) for igniting the propellant (25); and a locking device (30) having a locking position (38) in which the ignition unit (12) is held in a pre-loaded position (28) against an energy accumulator (23) and in which the cartridge chamber (18) remains open, and having a release position (39) in which the ignition unit (12) is displaced to an ignition position (29) thereof by the energy accumulator in which the cartridge chamber bottom (19) closes the cartridge chamber (18).

2. A setting tool according to claim 1, wherein the ignition element (22) is fixedly secured on the ignition unit (12) and is displaceable therewith.

3. A setting tool according to claim 2, wherein the ignition element (22) is formed as an ignition peg.

4. A setting tool according to claim 1, wherein the locking device (30) comprises at least one pivotal locking element (31) formed as a locking pawl (41), and wherein the locking pawl (41) has a locking position in which a pawl section (42) of the locking pawl (41) extends into a displacement path of the ignition unit (12), and a release position in which the pawl section (42) is pivoted out of the displacement path of the ignition unit (12).

5. A setting tool according to claim 4, wherein the locking element (31) is pivotally supported on an axle (44) provided on the housing (11).

6. A setting tool according to claim 4, wherein the locking element (31) is pivotally supported on an axle (44) secured on a servo-component (43) that is displaceable in the setting tool (10).

7. A setting tool according to claim 6, wherein the servo-component (43) is fixedly connected with the piston guide (13) for joint displacement therewith.

8. A setting tool according to claim 7, wherein the servo-component (43) is secured on the piston guide (13).

9. A setting tool according to claim 8, wherein a length of the servo-component (43) measured between a point of an attachment thereof to the piston guide (13) and the axle (44), which supports the locking element (31), at least corresponds to a maximal press-on path of the setting tool (10) when the setting tool is pressed against a constructional component.

10. A setting tool according to claim 6, wherein the servo-component (43) is fixedly connected with the bolt guide (24) for joint displacement therewith.

11. A setting tool according to claim 10, wherein the servo-component (43) is secured on the bolt guide (24).

12. A setting tool according to claim 10, wherein a length of the servo-component (43) measured between a point of an attachment thereof to the bolt guide (24) and the axle (44), which supports the locking element (31), at least corresponds to a maximal press-on path of the setting tool (10) when the setting tool is pressed against a constructional component.

13. A setting tool according to claim 4, further comprising switch means for displacing the locking element (31) from the locking position thereof (38) in which the locking element (31) engages the ignition unit (12).

14. A setting tool according to claim 4, further comprising spring means for biasing the locking element (31) to the locking position thereof in which it extends into the displacement path of the ignition unit (12).

15. A setting tool according to claim 4, wherein the locking element (31) is entrained when the ignition unit (12) is displaced from the ignition position (29) thereof to the pre-loaded position (28) thereof.

16. A setting tool according to claim 15, further comprising crank means (54) for pivoting the locking element (31) from the locking position thereof in which the locking element member engages the ignition unit (12), to the release position thereof.

17. A setting tool according to claim 4, wherein the pawl section (42) of the locking element (31) is spaced from a stop (17) provided in the housing (11), in the locking position (38) of the locking element (31), by a distance corresponding substantially to an axial length of the ignition unit (12).

18. A setting tool according to claim 17, further comprising a damping element (20) supported against the stop (17), and wherein the pawl section (42) of the locking element (31) is spaced from the stop (17) provided in the housing (11), in the locking position (38) of the locking element (31), by a distance corresponding substantially to the axial length of the ignition unit (12) and an axial length of the damping element (20).

19. A setting tool according to claim 1, further comprising safety means (33) having a release position (49) in which the safety means (33) does not extend into displacement path of the ignition unit (12), permitting displacement of the ignition unit in a direction toward the cartridge chamber (18), and having a locking position (48) in which the safety means (33) extends into the displacement path of the ignition unit, permitting displacement of the ignition unit (12) away from the cartridge chamber (18) but blocking the displacement of the ignition unit (12) in the direction toward the cartridge chamber (18).

20. A setting tool according to claim 19, wherein the safety means (33) comprises a catch pawl (46) pivotally supported on the setting tool.

21. A setting tool according to claim 19, further comprising spring means for biasing the safety element (33) to the locking position (48) thereof in which it extends into the displacement path of the ignition unit (12).

22. A setting tool according to claim 19, wherein the safety means (33) is entrained when with which the ignition unit (12) is displaced from the release position (29) thereof to the pre-loaded position (28) thereof.

23. A setting tool according to claim 22, further comprising means for pivoting the safety means (33) from the locking position (48) thereof in which the safety means engages the ignition unit (12), to the release position (49) thereof.

24. A setting tool according to claim 1, further comprising a guide (36) for a cartridge strip (26) fixedly secured on the housing (11) and with which the cartridge strip (26) is spaced, in an inoperative position of the setting tool, from both the cartridge chamber (18) and the ignition unit (12).

25. A setting tool according to claim 1, further comprising a guide (36) for a cartridge strip (26) and fixedly secured to a side of the ignition unit (12) facing the cartridge chamber (18) for joint displacement with the ignition unit.

* * * * *